US008284065B2

(12) United States Patent
Gonzales

(10) Patent No.: US 8,284,065 B2
(45) Date of Patent: Oct. 9, 2012

(54) DYNAMIC ALARM SENSITIVITY ADJUSTMENT AND AUTO-CALIBRATING SMOKE DETECTION

(75) Inventor: Eric Gonzales, Aurora, IL (US)

(73) Assignee: Universal Security Instruments, Inc., Owings Mills, MD (US)

( * ) Notice: Subject to any disclaimer, the term of this patent is extended or adjusted under 35 U.S.C. 154(b) by 558 days.

(21) Appl. No.: 12/572,707

(22) Filed: Oct. 2, 2009

(65) Prior Publication Data

US 2010/0085199 A1 Apr. 8, 2010

Related U.S. Application Data

(60) Provisional application No. 61/102,478, filed on Oct. 3, 2008.

(51) Int. Cl.
*G08B 17/10* (2006.01)

(52) U.S. Cl. ..... 340/629; 340/636.14; 340/573.7

(58) Field of Classification Search ..... 340/629, 340/628, 630–632, 636.15, 636.11–636.14, 340/660, 587–589, 600, 573.7, 577–579
See application file for complete search history.

(56) References Cited

U.S. PATENT DOCUMENTS 5,117,219 A 5/1992 Tice et al.
5,376,924 A * 12/1994 Kubo et al. ..... 340/632
5,530,433 A 6/1996 Morita
5,539,389 A 7/1996 Bystrak et al.
5,543,777 A 8/1996 Vane et al.
5,546,074 A 8/1996 Bernal et al.
5,552,765 A 9/1996 Vane et al.
5,557,262 A 9/1996 Tice
5,612,674 A 3/1997 Tice
5,627,515 A 5/1997 Anderson
5,736,928 A 4/1998 Tice et al.
5,764,142 A 6/1998 Anderson et al.
5,798,701 A * 8/1998 Bernal et al. ..... 340/628
5,831,524 A 11/1998 Tice et al.
6,107,925 A 8/2000 Wong
6,150,935 A 11/2000 Anderson
6,166,647 A * 12/2000 Wong ..... 340/628
6,166,648 A 12/2000 Wiemeyer et al.
6,222,456 B1 4/2001 Tice (Continued)

OTHER PUBLICATIONS

Bahrepour, M., et al., "Use of AI Techniques for Residential Fire Detection in Wireless Sensor Networks," AIAI-2009 Workshops Proceedings, Pervasive Systems Research Group, Twente University, the Netherlands, pp. 311-321.

(Continued)

*Primary Examiner* — Daniel Previl
(74) *Attorney, Agent, or Firm* — Cahn & Samuels, LLP

(57) ABSTRACT

A microprocessor controlled hazardous condition detection system with volatile and non-volatile memory containing a sensor package, the sensor package containing sensors exposed to the ambient environment, and an alarm element coupled to the sensor package through a microprocessor where the microprocessor includes a memory storage device containing a plurality of alarm thresholds stored therein, each of the plurality of alarm thresholds being associated with a predetermined set of levels in the ambient environment where the microprocessor receives periodic readings from the sensor package, the microprocessor conditions the received readings by removing a selected amount of noise and attenuation therefrom, selects and employs an optimized alarm threshold from a plurality of stored alarm thresholds and activates the alarm element upon detecting a threshold levels in the ambient environment greater than the selected alarm threshold.

17 Claims, 8 Drawing Sheets

U.S. PATENT DOCUMENTS

| | | | | |
|---|---|---|---|---|
| 6,320,501 | B1 | 11/2001 | Tice et al. | |
| 6,861,951 | B2 | 3/2005 | Reghetti et al. | |
| 6,975,223 | B1 | 12/2005 | Mladen et al. | |
| 7,076,403 | B2 | 7/2006 | Tice | |
| 7,142,105 | B2 * | 11/2006 | Chen | 340/521 |
| 7,154,402 | B2 | 12/2006 | Dayoub | |
| 7,161,481 | B2 | 1/2007 | Turner | |
| 7,170,418 | B2 | 1/2007 | Rose-Pehrsson et al. | |
| 7,218,708 | B2 | 5/2007 | Berezowski et al. | |
| 7,221,260 | B2 | 5/2007 | Berezowski et al. | |
| 7,227,450 | B2 | 6/2007 | Garvy et al. | |
| 7,242,292 | B2 | 7/2007 | Berezowski et al. | |
| 7,280,039 | B2 | 10/2007 | Ito et al. | |
| 7,307,539 | B2 | 12/2007 | Harvey et al. | |
| 7,327,247 | B2 | 2/2008 | Tice | |
| 7,649,450 | B2 | 1/2010 | Campion, Jr. et al. | |
| 2002/0118116 | A1 | 8/2002 | Tice et al. | |
| 2003/0004426 | A1 | 1/2003 | Melker et al. | |
| 2003/0020617 | A1 | 1/2003 | Tice et al. | |
| 2006/0192670 | A1 | 8/2006 | Tice | |
| 2006/0212570 | A1 | 9/2006 | Aritsuka et al. | |
| 2007/0110221 | A1 | 5/2007 | Berezowski et al. | |
| 2007/0152809 | A1 | 7/2007 | Berezowski et al. | |
| 2007/0188337 | A1 | 8/2007 | Mi et al. | |
| 2008/0068267 | A1 | 3/2008 | Huseth et al. | |
| 2008/0122696 | A1 | 5/2008 | Huseth et al. | |
| 2008/0180258 | A1 | 7/2008 | Lang et al. | |

OTHER PUBLICATIONS

Gottuk, D., et al., "Advaned Fire Detection Using Multi-signature Alarm Algorithms," Hughes Associates, Inc., Baltimore, MD, pp. 140-149.

Huckaby, E., et al., "Computational fluid dynamics modeling of the operation of a flame ionization sensor," 5th US combustion Meeting, Organized by the Western States Section of the Combustion Institute and Hosted by the University of California at San Diego, Mar. 2007.

Jones, W., "A Review and Implementation of Algorithms for Fast and Reliable Fire Detection," National Institute of Standards and Technology, Technology Administration, U.S. Department of Commerce, NISTIR 7060.

Roby, R, et al., "A Smoke Detector Algorithm for Large Eddy Simulation Modeling," NIST GCR 07-911, National Institute of Standards and Technology, Technology Administration, U.S. Department of Commerce.

Lazarus, Ron et al., "USI Proposal and Quotation, a Presentation to The Home Depot," May 27, 2009, USI Electric, Chicago, IL., USA.

Haigh, Phil et al., "USI Product Presentation, Home Safety Products-Alarms at the National Hardware Show," May 6, 2009, USI Electric, Chicago, IL., USA.

Muller, H. C., et al., "New Approach to fire Detection Algorithms Based on the Hidden Markov Model," International Conference on Automatic Fire Detection "AUBE '01", 12th Proceedings, National Institute of Standards and Technology, Mar. 25-28, 2001, pp. 129-138.

* cited by examiner

DYNAMIC ALARM SENSITIVITY ADJUSTMENT AND AUTO-CALIBRATING SMOKE DETECTION

PRIORITY CLAIM

This application claims the benefit of U.S. Provisional Application Ser. No. 61/102,478 filed on Oct. 3, 2008 which is incorporated herein by reference.

FIELD OF THE INVENTION

This invention relates to the field of hazardous condition detectors in general and specifically to a hazardous condition detector with ambient condition compensation.

BACKGROUND OF THE INVENTION

Fire detection devices are such as smoke detectors and/or gas detectors are generally employed in structures or machines to monitor the environmental conditions within the living area or occupied compartments of a machine. These devices typically provide an audible or visual warning upon detection of a change in environment conditions that are generally accepted as a precursor to a fire event.

Typically, smoke detectors include a smoke sensing chamber, exposed to the area of interest. The smoke detector's smoke sensing chamber is coupled to an ASIC or a microprocessor circuit. The smoke sensor samples the qualities of the exposed atmosphere and when a change in the atmosphere of the exposed chamber is detected by the microprocessor, an alarm is sounded.

There are two types of smoke sensors that are in common use. Optical or photoelectric type smoke sensors and ionization type smoke sensors. Photoelectric-based detectors are based on sensing light intensity that is scattered from smoke particles. Light from a source (LED) is scattered and sensed by a photosensor. When the sensor detects a certain level of light intensity, an alarm is triggered.

Ionization-type smoke detectors are typically based on a radioactive material that ionizes some of the molecules in the surrounding gas environment. The current of the ions is measured. If smoke is present, then smoke particles neutralize the ions and the ion current is decreased, triggering an alarm.

The ionization smoke detectors that are currently available in the market are very sensitive to fast flaming fires. This type of fire produces considerable energy and ionized particles and is easily detected by the sensor.

Although the ionization technology is very inexpensive compared with other technologies and had been installed in millions of homes, there is discussion regarding phasing out of this product category. It has been suggested by some members of the National Fire Protection Agency (NFPA) that ionization smoke sensors do not readily detect smoldering fires.

Smoldering fires most commonly, result from cigarette ignition of materials found in homes such as sofas and beds. A smoldering fire typically produces cold smoke particles of which only a small portion is ionized. Because ionization technology focuses on detection of ionized particles, smoldering fire detection may be inconsistent.

A variety of optical gas sensors for detecting the presence of hazardous gases, especially carbon monoxide ("CO"), are also known.

Typically, optical gas sensors include a self-regenerating, chemical sensor reagent impregnated into or coated onto a semi-transparent substrate. The substrate is typically a porous monolithic material, such as silicon dioxide, aluminum oxide, aluminosilicates, etc. Upon exposure to a predetermined target gas, the optical characteristics of the sensor change, either darkening or lightening depending on the chemistry of the sensor.

Smoke and gas sensors can be affected by temperature, humidity, and dust particles. One or a combination of these ambient factors can cause a smoke or gas detector to false alarm.

SUMMARY OF THE INVENTION

Disclosed is a microprocessor controlled hazardous condition detection system including a housing containing a sensor package, the sensor package containing sensors exposed to the ambient environment. The sensors take periodic readings of predetermined environmental conditions. The disclosed system also includes an alarm means coupled to the sensor package through a microprocessor having volatile and non-volatile memory.

The non-volatile memory features an alarm differential value stored therein and a designated clean air alarm threshold being stored in said non-volatile memory as well. Upon system power-up, the clean air alarm threshold is loaded into the volatile memory; and the microprocessor receives periodic readings of predetermined environmental conditions from said sensor package. The microprocessor stores the periodic readings in the volatile memory, and calculates an average of a plurality of the periodic readings. The microprocessor generates a new alarm threshold by shifting the clean air alarm threshold loaded into the volatile memory by the difference in the calculated average environmental reading and the clean air alarm threshold.

Also disclosed is a hazardous condition detector that is ionization-technology-based optimized to readily detect smoldering as well as traditional flash fires. This technology is an improvement over existing photoelectric detector technology by providing a sensor possessing enhanced detection capabilities for fast flaming fires. Performance of the disclosed invention corresponds to a dual technology alarm system incorporating separate photo and ion sensors while using only the more economical ionization sensors.

The disclosed invention employs microprocessor control to analyze the character/type of smoke by tracking the rate of rise of the sensor signal over a predetermined time period. Smoldering fires yield a slow but persistent change in ionization signal and fast flaming fires will produce rapid measured signal change. Rate of rise will be different depending on the type of fire. By employing periodic sampling and using a microprocessor to evaluate the rate of ionized particle change, both types of fires are readily detected.

Also disclosed is a method for compensating the alarm threshold in a hazardous condition detector for changes in ambient conditions including a hazardous condition detector having a sensor package coupled to a microprocessor having volatile and non volatile memory. Programming a clean air reading into the non-volatile memory of the detector and setting a threshold differential value for an alarm condition.

The method also includes defining a default alarm threshold based on the differential value and the clean air reading and storing the default alarm threshold in the volatile memory. The method also includes collecting a first environmental reading at time T1, with the sensor package, storing the first environmental reading in volatile memory as environmental sample 1, collecting a second environmental reading at time T2 with the sensor package and storing the second environmental reading in volatile memory as environmental sample 2, as well as collecting a third environmental reading at time T3 with the sensor package and storing the third 3 environmental reading in volatile memory as environmental sample 3.

The method also includes computing an average environmental reading from T1, T2, and T3 to produce an environmental reading avg. and computing the difference between the computed environmental reading avg. and the default alarm threshold. The method also includes defining a new alarm threshold by shifting the default alarm threshold by the difference between the computed environmental reading avg. and the default alarm threshold and storing the new alarm threshold as the default alarm threshold in the volatile memory.

Auto calibration allows the product to accurately calculate an alarm reference. Presently, conventional ionization alarms, employ a resistor divider is to set the alarm reference. By making the resistor divider reference the same for all products manufactured from the same batch production is simplified. However, the use of a resistor divider results in products exhibiting a relatively wide range of sensitivities. Some, being very sensitive will alarm readily. Others being too insensitive will not easily respond to fires. Consequently, ionization detectors that are too insensitive may be very insensitive to smoldering fires.

The present invention also features auto-calibration for dynamically establishing the alarm-threshold-reference based on a measurement of clear air. As such, the calibration technology of the present invention is based on the "smart" performance of a microcontroller. By relying on in situ calibration, the disclosed detector alarm units possess similar if not the same sensitivity level across different manufacturing batches and enable dynamically modified and accurate alarm sensitivity level adjustment. Alarm sensitivity may be increased when a smoldering fire is detected to allow the product to alarm faster even with small levels of detected signal. Also, the alarm sensitivity may be decreased when a fast flaming fire is detected to minimize nuisance alarms.

The present invention also discloses a smoke ASIC Wake Up feature wherein the smoke ASIC is used in conjunction with the microcontroller. The ASIC performs other necessary features of a smoke detector such as multi-station, communication, horn driving, low battery detect, signal latching, and buffering of the smoke sensor signal. The disclosed wake up feature minimizes power consumption by employing a microprocessor halt or active halt mode. The sensitivity pin of the ASIC is used as an external interrupt to wake up the microprocessor.

BRIEF DESCRIPTION OF THE DRAWINGS

In order to describe the manner in which the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION

Various embodiments are discussed in detail below. While specific implementations of the disclosed technology are discussed, it should be understood that this is done for illustration purposes only. A person skilled in the relevant art will recognize that other components and configurations may be used without departing from the spirit and scope of the invention.

Figure 1:
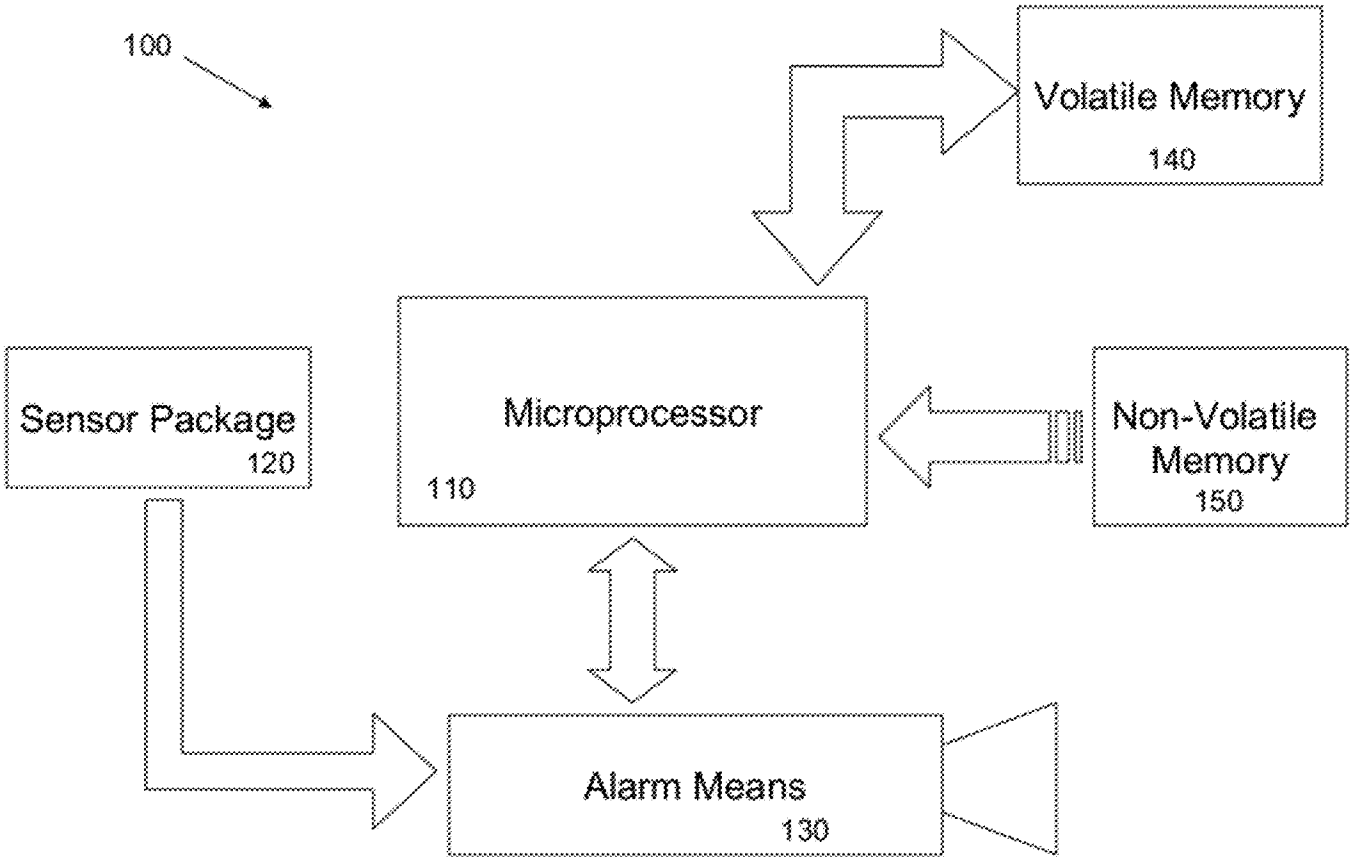
FIG. 1 is a block diagram of an exemplarily embodiment of a microprocessor controlled hazardous condition detection system employing the disclosed ambient condition compensation feature.

Referring now to the figures, wherein like reference numbers denote like elements, FIG. 1 illustrates an exemplarily embodiment of a microprocessor controlled hazardous condition detection system employing the disclosed ambient condition compensation feature. As shown in FIG. 1, the hazardous condition detection system 100 features a housing 101 containing a sensor package 120. The sensor package 120 contains at least one sensor that is exposed to the ambient environment and takes periodic readings of at least one predetermined environmental condition. The sensor package 120 may be comprised of a smoke sensor, a gas sensor, a heat sensor or other sensor, such as a motion sensor. In addition, the sensor package may feature a combination of sensors that provides periodic reading of a plurality of environmental conditions.

Figure 7:
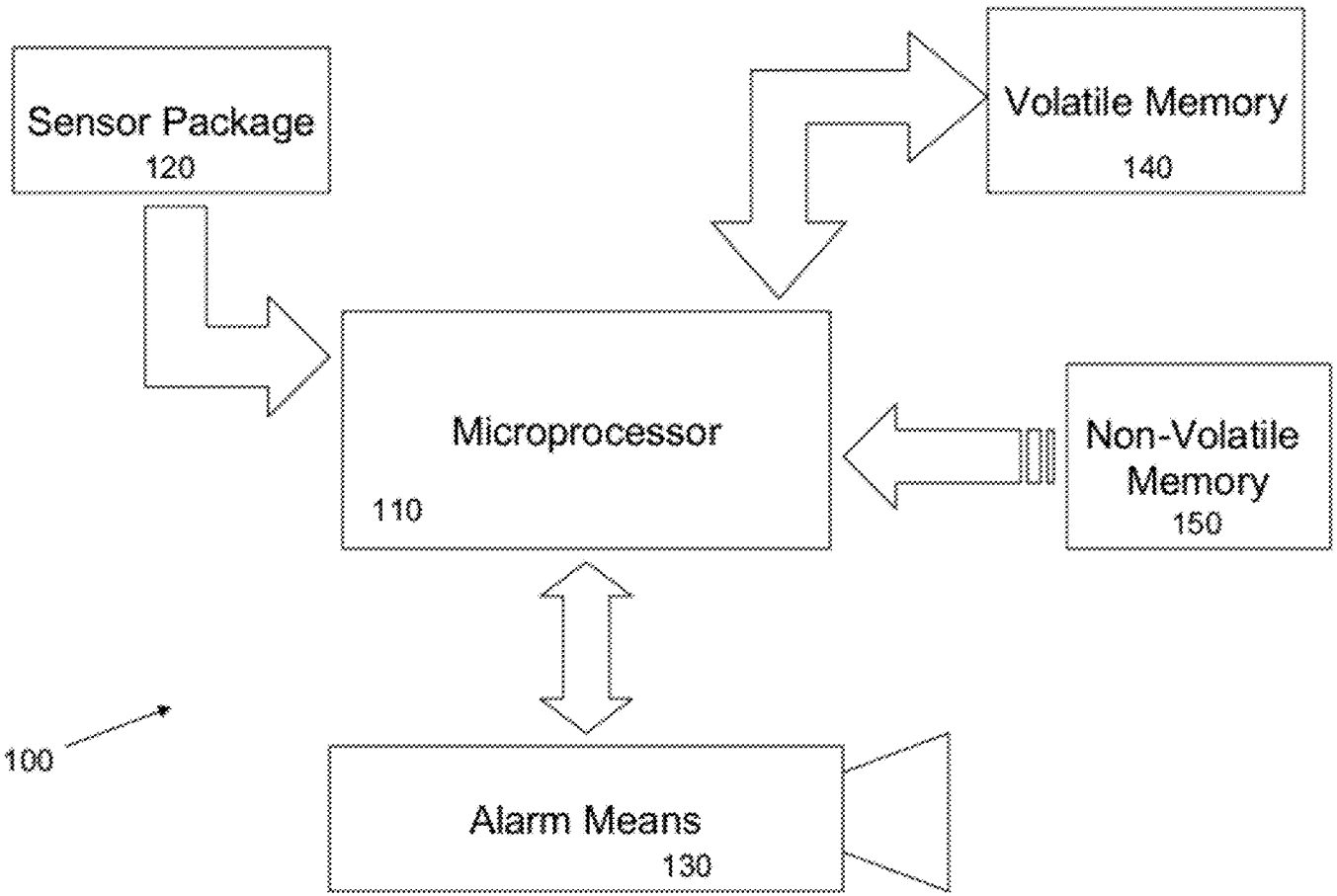
FIG. 7 is a block diagram of an example embodiment of the system for hazardous condition detection wherein the sensor package is coupled directly to the microprocessor.

Sensor package 120 is coupled to at least one microprocessor 110 via an alarm means 130. Alarm means 130 is an ASIC optimized for hazardous condition detector use (smoke, gas, intrusion, etc.) and any supporting components including the visual, electronic, optical, magnetic and or audible signaling components. In other embodiments, the sensor package 120 may be coupled directly to the microprocessor 110 as illustrated in FIG. 7. Microprocessor 110 is coupled to or features volatile 140 and non-volatile memory 150. The volatile 140 and non volatile memory 150 may be resident on the microprocessor 110, or it may be embodied in a different or combination of chips.

In example embodiments microprocessor 110 employs a comparison algorithm to determine the existence of a hazardous condition. A reading without smoke, dangerous levels of gas or other contaminants (clear air) is taken at the factory. This value is stored in non-volatile memory 150 which is typically in the form of an EEPROM or FLASH memory. The alarm level, or alarm threshold is determined by the software by subtracting a predetermined alarm threshold differential from the default clear air reading. The hazardous condition detector generates an alarm when the signal of the sensor, reaches or surpasses the alarm threshold level. The determination of an alarm condition is governed by the following relation:

Default clean air−alarm threshold differential=X, if X is greater than or equal to alarm threshold level, then alarm condition is met and the system goes into alarm mode.

As denoted by the arrows in FIG. 1, microprocessor 110 receives information from the non-volatile memory 150 and retrieves and stores information from the volatile memory 140. The non-volatile memory 150 contains an alarm differential value, and a clean air default value stored therein. The data in the non-volatile memory designating the alarm differential value and the clean air default value are typically set and calibrated at the factory, however one or more of the default settings in the non-volatile memory may be set and calibrated at a later date. Microprocessor 110 selects a default alarm threshold, by adding the differential value to the clean air default value.

This auto-calibration feature enables minimized alarm threshold variations between manufactured products providing for consistent alarm thresholds for a plurality of manufactured products. This consistency enables a manufacture or end user to dynamically vary the alarm threshold values to obtain consistent results for the different types of fires (Underwriter Laboratories—Paper, Wood, Flammable Liquid Fire Test).

Very insensitive units for example may not respond to smoldering fires even if the sensitivity level is increased. Very sensitive units wherein alarm threshold is lowered after detecting smoldering fire may become very sensitive resulting to false (nuisance) alarms.

Figure 2:
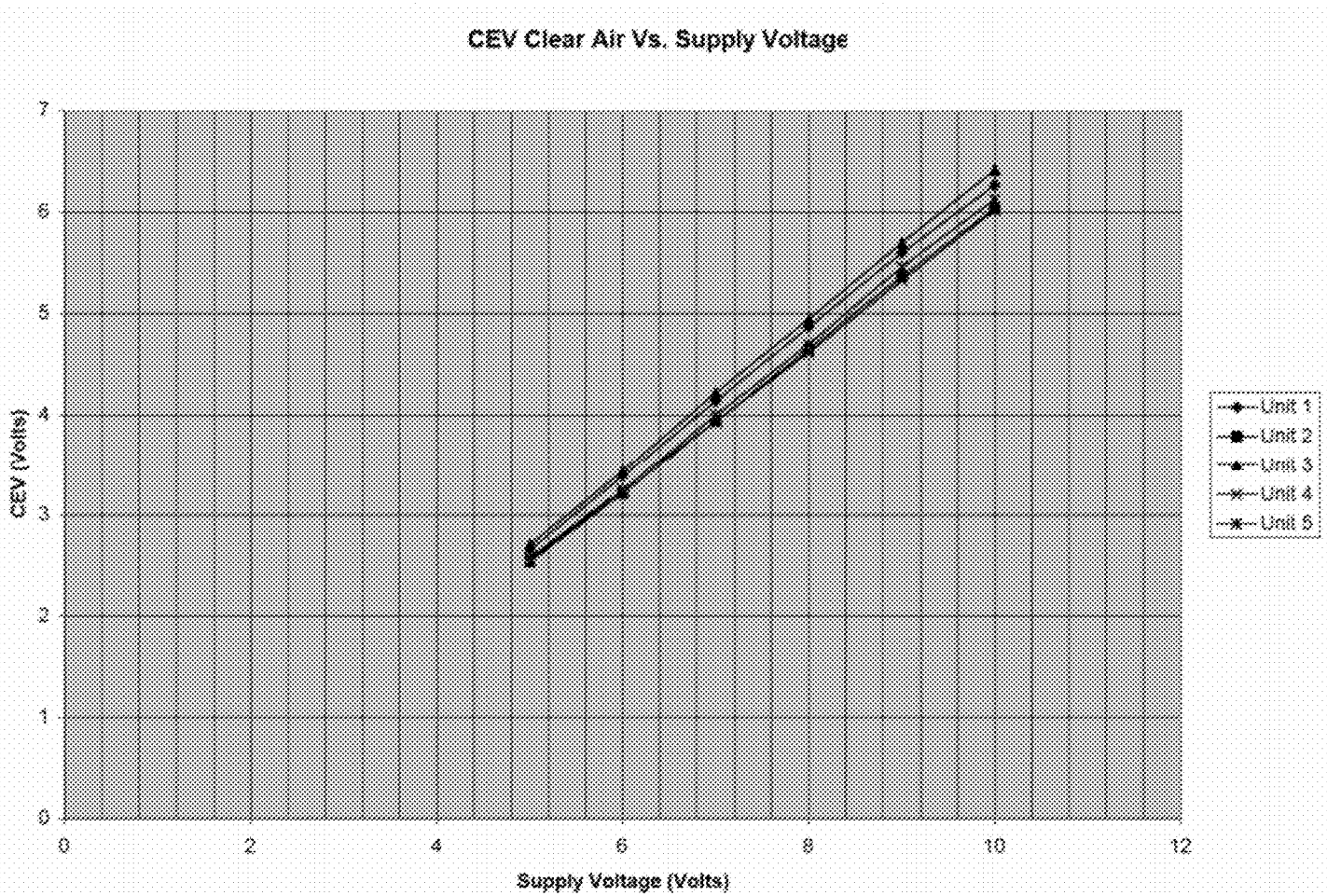
FIG. 2 is a graph illustrating the output of the ionization sensor (CEV—Central Electrode Voltage) versus the supplied voltage to the sensor.
Figure 3:
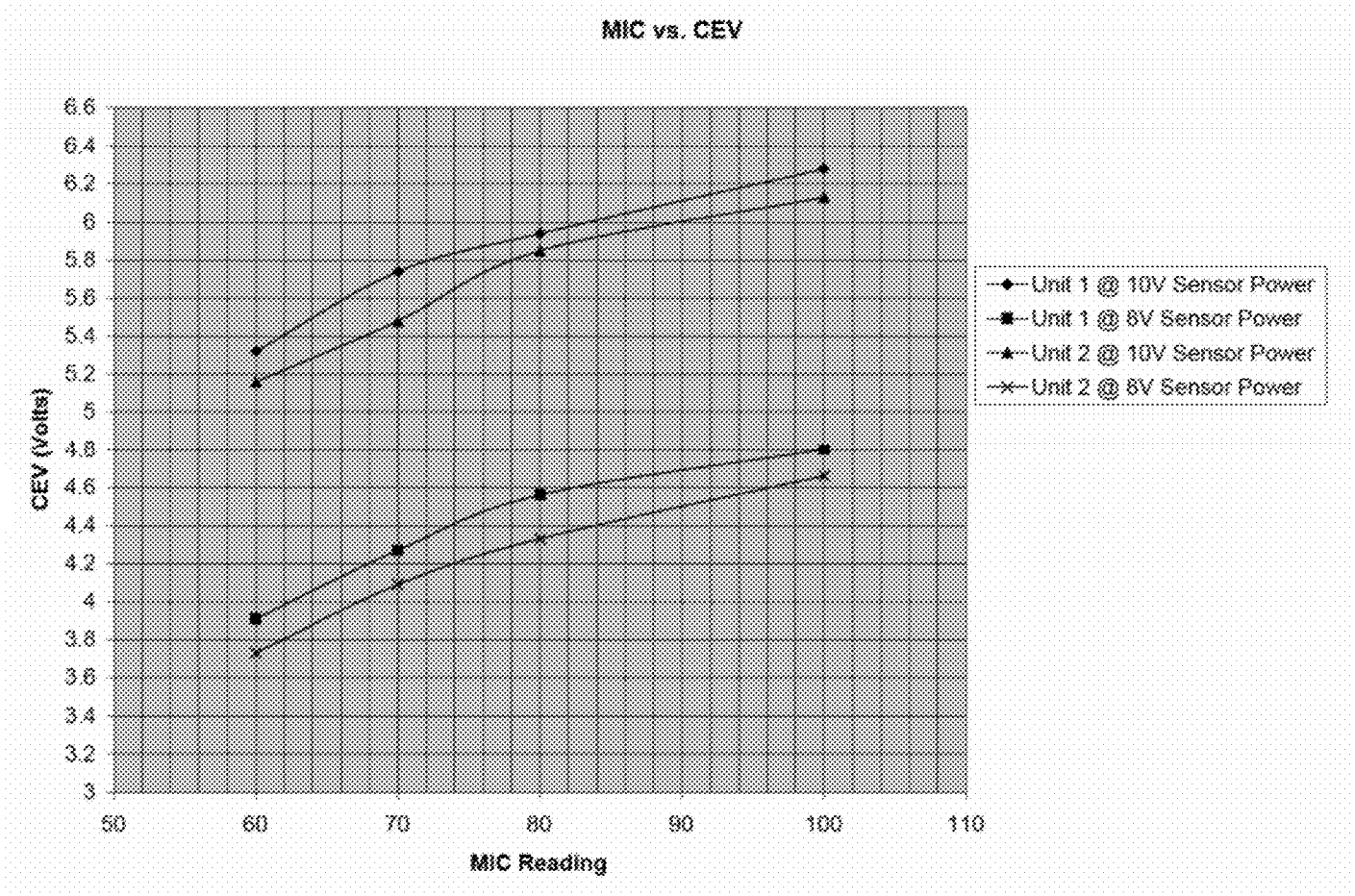
FIG. 3 is a graph illustrating obtained using a UL smoke box and is a graph of the CEV versus the amount of smoke (ionized particles) read by the smoke box.

To illustrate how consistent alarm thresholds are attained, one can analyze the response of the ion sensor to voltage supply and smoke. Battery supplied products typically have the voltage supply decreasing as the battery gets depleted and output of the sensor changes as a function of the amount of smoke present. FIG. 2 and FIG. 3 illustrate the sensor output response due to the two parameters mentioned. FIG. 2 is a graph of the output of the sensor (CEV—Central Electrode Voltage) versus the supplied voltage to the sensor.

Figure 8:
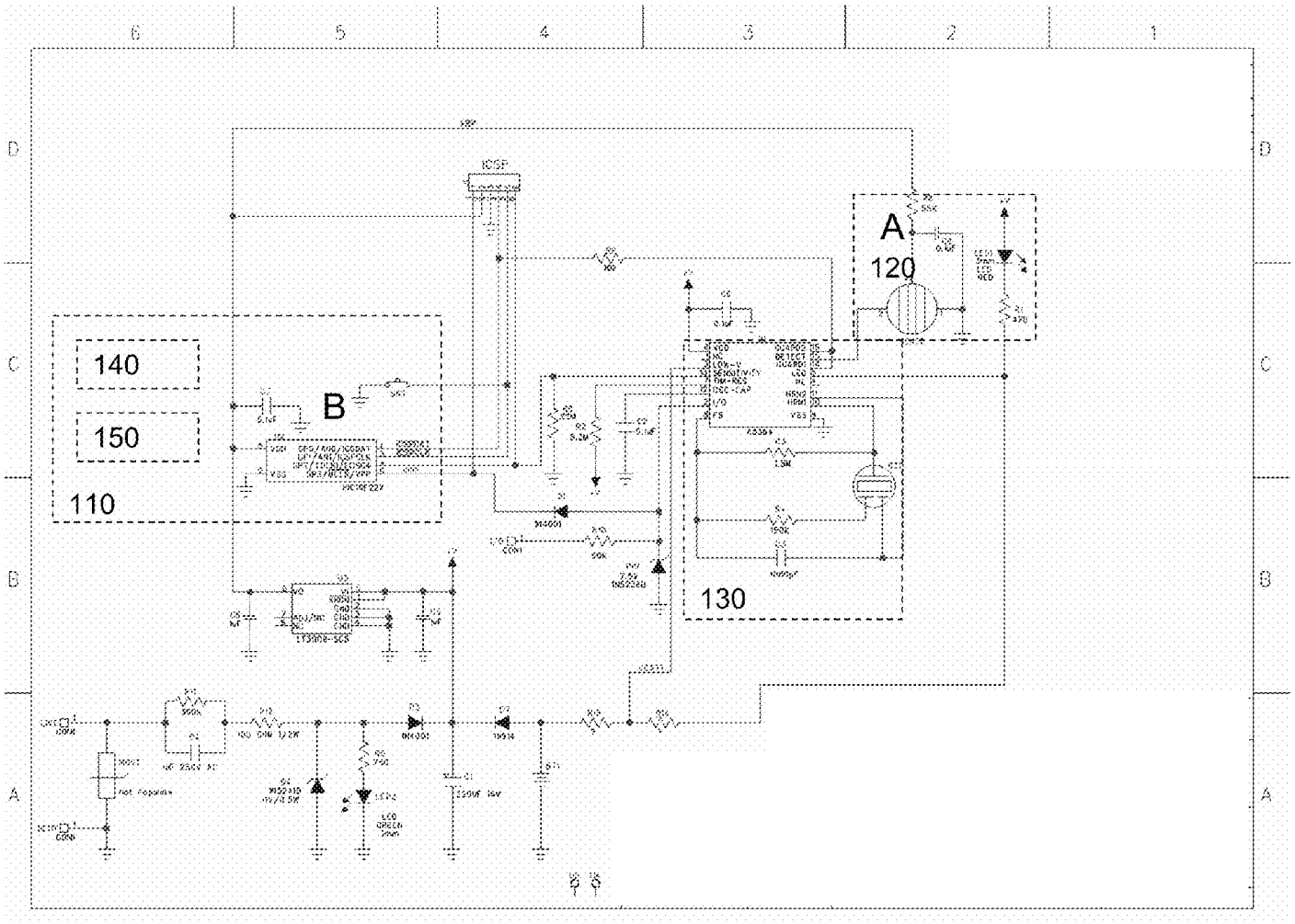
FIG. 8 is an exemplary schematic illustrating circuitry to achieve the invention using a smoke detector ASIC coupled directly to the sensor package.

FIG. 2 is based on clear air reading (no smoke) while varying the voltage at point 'A' of FIG. 8. Point A is attached to the cover of the ion sensor. The resulting graphs on five samples are straight lines intersecting at a single point on the X axis ($V_{@Xintercept}$). With the linear equation, the CEV for a particular sample in clear air, for any voltage, can be computed if a single clear air point ($V_{@calibration}$, $CEV_{@calibration}$) is known. This point is taken in the factory during auto-calibration. The equation for any CEV at a voltage supply 'V' is:

$$CEV=(CEV_{@calibration}/\{V_{@calibration}-V_{@Xintercept}\})*(V-V_{@Xintercept})$$

FIG. 3 is obtained using a UL smoke box and is a graph of the CEV versus the amount of smoke (ionized particles) read by the smoke box. The ion sensor is exposed to a UL prescribed smoke build-up inside the smoke box. The output CEV of the product is measured and plotted against the smoke reading obtained by the smoke box (MIC Reading). Two samples were used to generate this graph. The upper to curves are CEV outputs of the two samples when using a 10 volt supply. The lower two curves are plots of the output when 8V is used. MIC reading at 100% is clear-air. As smoke increases the MIC reading decreases. Even when different power supply levels are used, the resulting decrease and rate of decrease in CEV level is the same for the two power supply levels. Going from 100% MIC down to 60% MIC is about 1V decrease in CEV for both voltage supply levels.

A very consistent alarm level can now be computed for any product powered by any voltage level. The resulting equation is:

$$\text{Alarm Level}=CEV_{clear\text{-}air}-\text{Constant}_{alarm\ threshold}.$$

Where CEV is given by the formula above and 'Constant' is a voltage to alarm at a certain MIC reading. These formulas are used by the microprocessor to compute for the default alarm level. The default alarm level is dynamically varied depending on the profile (rate of CEV change per time) of the fire.

Referring again to FIG. 1, when system 100 is initially powered up, the default air alarm threshold is loaded into the volatile memory 140. The microprocessor 110 receives periodic readings of predetermined environmental, or ambient, conditions from the sensor package 120, and stores the periodic readings of the environmental conditions in the volatile memory 140. The microprocessor 110 calculates an average of the three most recent readings and generates a new alarm threshold based on the average. The new alarm threshold is generated by shifting the default air alarm threshold loaded into the volatile memory 140 by the difference in the calculated average environmental reading and the clean air default value. When the system detects an ambient environmental condition outside of the alarm threshold stored in the volatile memory 140, the microprocessor 110 designates an alarm event and causes the alarm means 130 to generate an alarm.

This process of adjusting or varying the alarm threshold value within the given allowable range enables the system to dynamically adjust the sensitivity of the detector depending on the changes in the ambient conditions in the monitored space such as variations in the type of smoke detected. Typically, fast flaming fire will have a higher alarm threshold and a smoldering fire will have less. All alarm levels are typically based on the rate of decrease of CEV reading with respect to time. By varying the alarm thresholds via a microprocessor based on the ambient condition variations over time smoldering fires can now be efficiently detected with ionization type detectors. Since these types of fire events typically yield a slow but persistent decrease in CEV signal while fast flaming fire events produce rapid measured signal decrease. The alarm sensitivity level may be increased (threshold lowered) when smoldering fire is detected to allow the product to alarm faster even with small levels of detected signal.

Figure 4:
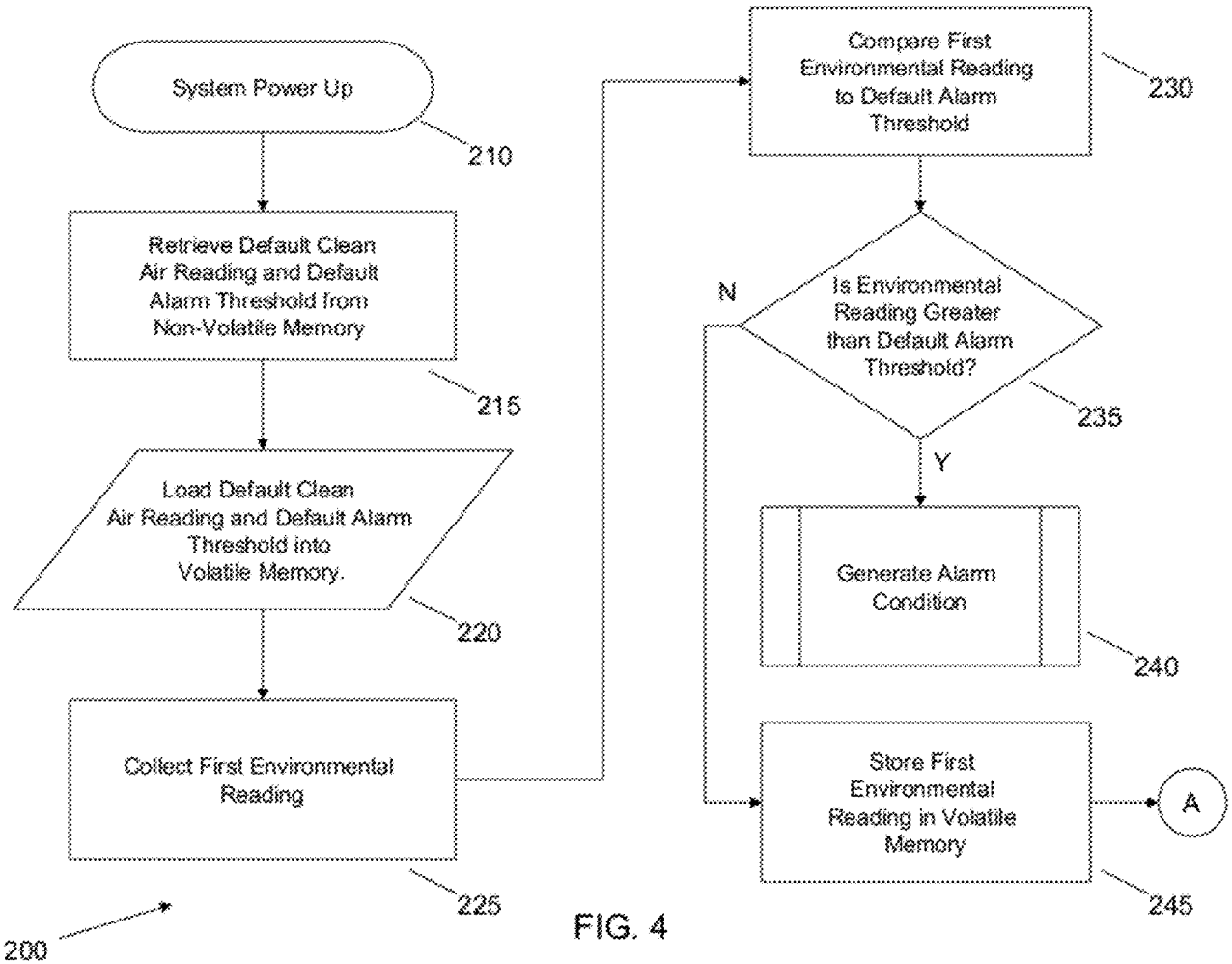
FIG. 4 is a flow diagram of an exemplarily embodiment of a method for providing ambient condition compensation in a hazardous condition detector.

Referring now to FIG. 4 with continued reference to FIG. 1, FIG. 4 shows a flow diagram of an exemplarily embodiment of a method for providing ambient condition compensation in a hazardous condition detector. This flow diagram illustrates the operation of the hazardous condition detector at the point of system power-up when the detector is deployed. The default clean air reading and the default alarm threshold values have previously been calibrated and loaded into the non-volatile memory of the system.

As shown in FIG. 4, at system power up 210, the point at which the hazardous condition detector is connected to a power supply and deployed, the Microprocessor 110 will retrieve the default clean air reading and default alarm threshold 215 from the non-volatile memory 150.

The microprocessor 110 loads the default clean air reading and the default alarm threshold 220 into the volatile memory 140 of the system. Once the default values are loaded into the volatile memory 140, the system goes into detection mode and collects the first of a plurality of environmental readings 225 to be evaluated by the microprocessor 110 for the existence of a hazardous condition. The microprocessor accomplishes this by comparing the first environmental reading to the default alarm threshold 230 stored in the volatile memory 140. If the first environmental reading is greater than, or otherwise beyond the parameters set forth in the default alarm threshold, 235 the microprocessor 110 will conclude there exists a hazardous condition and go into alarm mode generating an alarm 240. If the environmental reading is determined to be with the parameters set forth in the default alarm threshold 235, the microprocessor with store the first environmental reading in volatile memory 245.

Yet another aspect of ambient condition compensation is the dynamic alarm adjustment feature. The dynamic alarm adjustment feature provides methods and apparatus by which the alarm threshold is adjusted over time to provide optimal alarm event recognition by evaluating one or more characteristics of the ambient environment.

Figure 5:
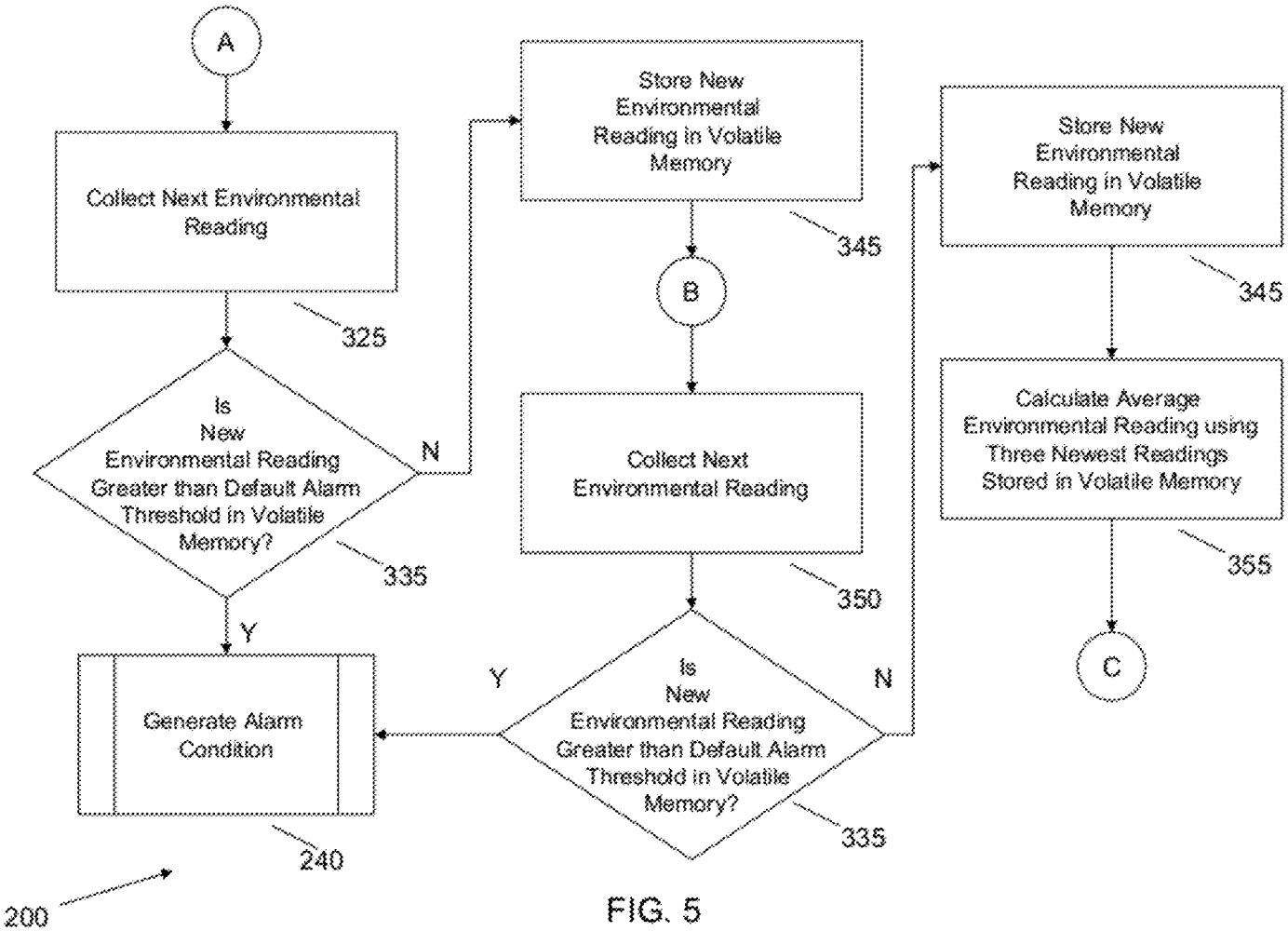
FIG. 5 is a continuation of the flow diagram of FIG. 4 illustrating an exemplarily embodiment of a method for providing ambient condition compensation in a hazardous condition detector.

Referring now to FIG. 5 with continued reference to FIG. 1 and FIG. 4, once the first environmental reading is stored in volatile memory 245 at a predetermined interval the sensor package collects another environmental reading 325. The microprocessor 110 will evaluate the new environmental reading. The microprocessor compares the new environmental reading to the default alarm threshold 335 stored in the volatile memory 140. If the new environmental reading is greater than, or otherwise beyond the parameters set forth in the default alarm threshold, 335 the microprocessor 110 will conclude there exists a hazardous condition and go into alarm mode generating an alarm 240. If the new environmental reading is determined to be within the parameters set forth in the default alarm threshold 335, the microprocessor stores the new environmental reading in volatile memory 345.

The microprocessor 110, then collects the next environmental reading 350 from the sensor package 120 and evaluates the new environmental reading. The microprocessor again compares the new environmental reading to the default alarm threshold 335 stored in the volatile memory 140. If the new environmental reading is greater than, or otherwise beyond the parameters set forth in the default alarm threshold, 335 the microprocessor 110 will conclude there exists a hazardous condition and go into alarm mode generating an alarm 240. If the new environmental reading is determined to be within the parameters set forth in the default alarm threshold 335, then the new environmental reading is stored 345 in volatile memory 140 with previous collected environmental readings. The microprocessor calculates an average environmental reading by taking at least three of the newest readings stored in the volatile memory 355 to determine the ambient environmental average.

Figure 6:
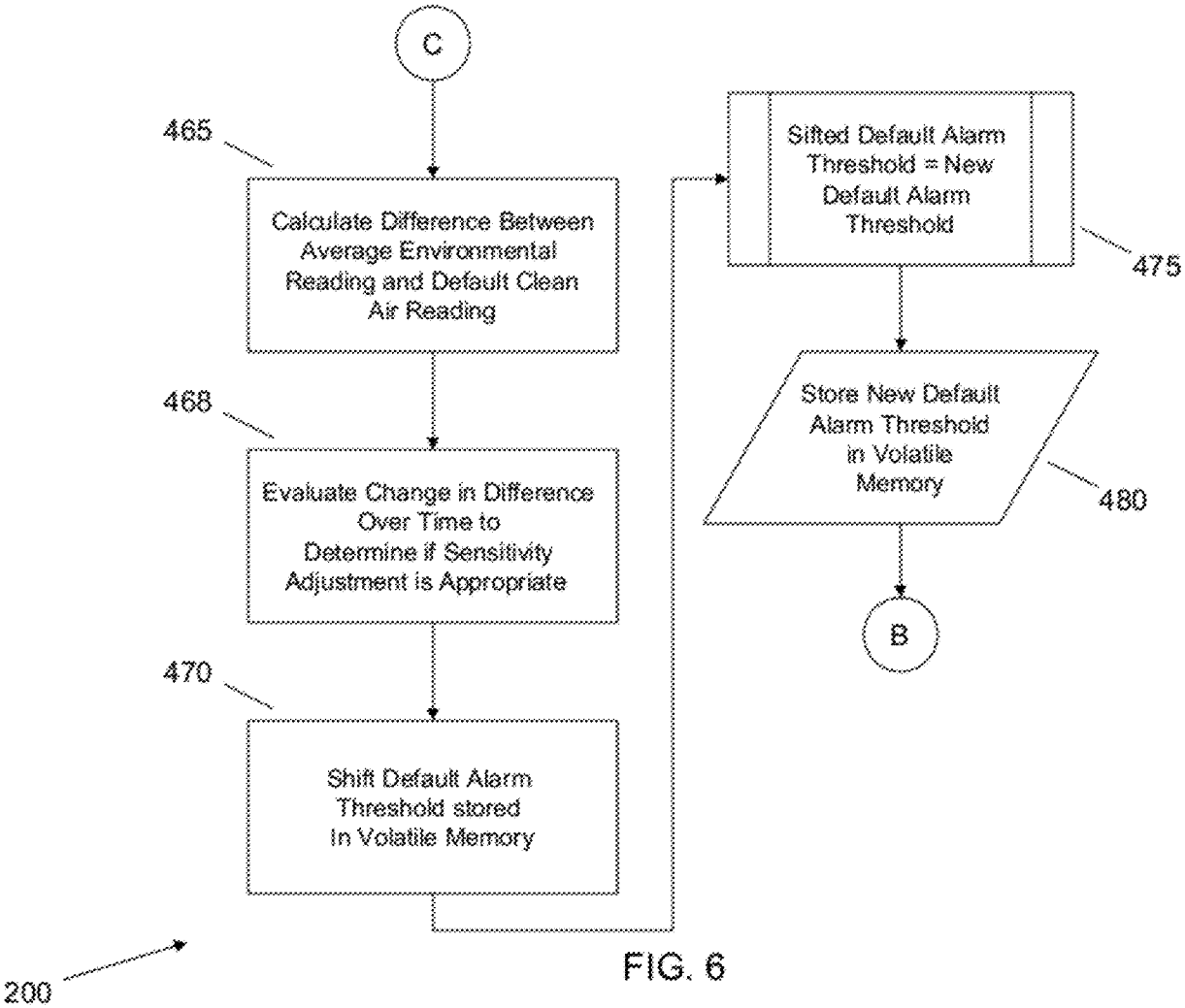
FIG. 6 is the continuation of the flow diagram of FIG. 4 and FIG. 5 illustrating an exemplarily embodiment of a method for providing ambient condition compensation in a hazardous condition detector.

Referring now to FIG. 6 with continued reference to FIGS. 1, 4 and 5, microprocessor 110 then calculates the difference between the average environmental reading and the default clean air reading 465 also contained in volatile memory 140. The microprocessor will then shift the default alarm threshold stored in volatile memory 470 by the calculated difference between the average environmental reading and the default clean air reading and designate the shifted default alarm threshold as the new default alarm threshold 475 and store the new default alarm threshold in volatile memory 480. The process of collecting, evaluating and storing the environmental readings collected by the sensor package repeats at predetermined intervals, effectively compensating the alarm threshold for changes in the ambient conditions over time. The compensation may be in the form of increased sensitivity via a higher alarm threshold, or decreased sensitivity depending on the sensor package, time or other variables. These changes in ambient conditions can be changes in temperature, ionization levels, CO levels, smoke levels or a combination of a plurality of conditions.

In the various embodiments the microprocessor will evaluate the ambient conditions and adjust the alarm thresholds, and subsequent alarm sensitivity based on the type of sensors used and the variations in a plurality of the ambient conditions detected by the sensor package. This aspect of the disclosed invention lends itself to application in hazardous condition detection systems that employ ionization type smoke sensors. A gradual change in the ionization levels detected over time (for example a 2 hour period of increasing ionization levels detected by a sensor) suggest the existence of slow burning or smoldering fire event. Typically an ionization type detector would not perform as well as a detector employing an optical sensor, due to the reduced ionization levels, however by employing the above disclosed ambient condition compensation feature and evaluating the ionization sensor readings over time the microprocessor determines the existence of a fire event and issues an appropriate alarm.

In yet another embodiment the invention is embodied in a method for compensating the alarm threshold in a hazardous condition detector for changes in the environment or ambient conditions comprising. The method, employed in a hazardous condition detection system includes programming a default clean air reading into the non-volatile memory of a hazardous condition detector and setting a threshold differential value for an alarm condition. The method also includes defining a default alarm threshold based on the differential value and the default clean air reading. The method also includes storing said default clean air reading and said default alarm threshold in the volatile memory and collecting a first environmental reading at time T1, with the sensor package. The first environmental reading is stored in volatile memory as environmental sample 1.

The system collects a second environmental reading at time T2 with the sensor package and stores the second environmental reading in volatile memory as environmental sample 2. The method also includes collecting a third environmental reading at time T3 with the sensor package and storing said third 3 environmental reading in volatile memory as environmental sample 3. The method also includes computing an average environmental reading from T1, T2, and T3 to produce an environmental reading avg. The environmental average reading is essentially an ambient condition reading for the deployed environmental condition detector.

The method also includes computing the difference, or delta, between the computed average environmental reading and the default clean air reading. A new alarm threshold is then defined by shifting the default alarm threshold by the difference, or delta, between the computed average environmental reading and the default clean air reading. The method also includes storing the new alarm threshold as the default alarm threshold in the volatile memory. Each environmental reading taken by the sensor package is compared to the default alarm threshold currently stored in the volatile memory, it the reading is determined to be greater than the default alarm threshold then stored in said volatile memory and alarm event is determined to exist and the alarm means will generating an alarm.

In yet another embodiment the method includes computing the difference, or delta, between the computed average environmental reading and the default clean air reading and determining if the computed difference has changed greater than a predetermined amount over a predetermined time, shifting the default alarm threshold by a fraction of the difference, or delta, between the computed average environmental reading and the default clean air reading. The method also includes storing the new alarm threshold as the default alarm threshold in the volatile memory. Each environmental reading taken by the sensor package is compared to the default alarm threshold currently stored in the volatile memory, it the reading is determined to be greater than the default alarm threshold then stored in said volatile memory and alarm event is determined to exist and the alarm means will generating an alarm.

In yet another embodiment the microprocessor calculates the difference between the first and second environmental readings, and the difference between the second and third environmental readings, evaluating each calculated difference as a function of the time period between the environmental readings, and shifting the new alarm threshold by a value greater than the difference between the computed environmental reading avg. and the default clean air reading to decrease system sensitivity. The microprocessor increases the sensitivity by shifting by a value less than the difference between the computed environmental reading avg. and the default clean air reading. The sensitivity is maintained by shifting by the actual difference.

In yet another embodiment the hazardous condition detection system incorporates an energy savings feature. Specifically the power is conserved by employing microprocessor sleep mode and periodic wake up signal sent to the microprocessor through the sensitivity set pin of a typical smoke ASIC. This power conservation feature extends the operational life of battery powered units by a large margin. This is very significant in view of the widespread use of battery powered system and the failure rate of these units due to depleted battery power. This is accomplished by employing the sensitivity pin of the ASIC is used as an external interrupt to wake up the microcontroller. The ASIC performs all other necessary features of a smoke detector such as communication, horn driving, low battery detect, and buffering of the smoke sensor signal.

Referring now to FIG. 8, which shows an exemplary schematic diagram of circuitry employed to achieve the Wake up feature of the instant invention using a smoke detector ASIC. The Sensitivity Set is typically used to adjust the sensitivity of the smoke detector by attaching resistors thereto. In the example embodiment the sensitivity set is Pin 13. Pin 13 of this ASIC is attached to pin 4 of the microprocessor as seen in FIG. 8 point 'B'. Typically this pin is only active for 10 mS every 1.67 second period. When this pin is not active, it is placed on high impedance state. When the pin is inactive the microprocessor goes into what can be described as a "halt" or "active halt" mode, minimizing the system's power consumption. When the pin is active the microprocessor interrupt is extinguished and the microprocessor wakes. Since the microprocessor is not always active and consuming the systems power, extended operational life when dependent on battery power is realized compared to conventional configurations.

When pin 13 is active the impedance is low allowing current flow to the microprocessor coupled to the pin. The current flow in pin 13 wakes the microprocessor and the microprocessor is active during the 10 mS period. During this 10 mS the microprocessor retrieves/receives the sensor package measurements, evaluates the results, and determines if an alarm event exist. If an alarm event is determined to exist, the microprocessor forces pin 13 to go to a high voltage overriding the deactivation signal forcing the ASIC into an alarm mode. If no alarm event is detected by the microprocessor during the active period the microprocessor does not override pin 13 and will return to sleep mode until the ASIC's next 10 mS active period.

Since the microprocessor spends a significant amount of time, corresponding to the ASIC's inactive period, in sleep mode a substantial power savings is realized. This conservation of battery power significantly extends the system's battery life.

It will be understood that each block of the flowchart illustrations and block diagrams and combinations of those blocks can be implemented by computer program instructions and/or means.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A microprocessor controlled hazardous condition detection system comprising:

a housing containing a sensor package, said sensor package containing sensors said sensors being exposed to an ambient environment and taking periodic readings of predetermined environmental conditions;

an alarm means associated with said sensor package and disposed in said housing;

a microprocessor electronically coupled to said alarm means and sensor package, said microprocessor having volatile and non-volatile memory, said non-volatile memory having an alarm differential value and a clean air default value stored therein;

wherein a default alarm threshold is determined by adding said differential value to said clean air default value;

wherein upon system power-up, said default alarm threshold is loaded into said volatile memory; said microprocessor receives periodic readings of predetermined environmental conditions from said sensor package stores said periodic readings in said volatile memory, calculates an average of a plurality of said periodic readings and generates a new alarm threshold by shifting the default alarm threshold loaded into said volatile memory by a value derived from the difference in the calculated average environmental reading and said clean air default value;

wherein upon detection of an ambient environmental condition outside of said alarm threshold stored in said volatile memory said microprocessor causes said alarm means to generate an alarm condition.

2. The system of claim 1, wherein said alarm differential value is stored in said non-volatile memory at the point of manufacture.

3. The system of claim 1, wherein said clean air default value is stored in said non-volatile memory at the point of manufacture.

4. The system of claim 1, wherein said sensor package comprises at least one sensor for detecting smoke.

5. The system of claim 4, wherein said at least one sensor for detecting smoke is an ionization type sensor.

6. The system of claim 5, wherein said sensor package further comprises at least one smoke sensor that is of the photoelectric type.

7. The system of claim 5, wherein said sensor package comprises at least one gas sensor.

8. The system of claim 5, wherein said microprocessor shifts the default air alarm threshold loaded into said volatile memory by a value greater than the difference in the calculated average environmental reading and said clean air default value to decrease system sensitivity.

9. The system of claim 5, wherein said microprocessor shifts the default air alarm threshold loaded into said volatile memory by a value less than the difference in the calculated average environmental reading and said clean air default value to increase system sensitivity.

10. A method for compensating the alarm threshold in a hazardous condition detector having a sensor package operatively coupled to a microprocessor having volatile and non volatile memory for changes in ambient conditions comprising:

programming a default clean air reading into the non-volatile memory of the detector;

setting a threshold differential value for an alarm condition;

defining a default alarm threshold based on the threshold differential value and said default clean air reading;

storing said default clean air reading and said default alarm threshold in the volatile memory;

collecting a first environmental reading at time T1, with the sensor package;

storing said first environmental reading in volatile memory;

collecting a second environmental reading at time T2 with the sensor package;

storing said second environmental reading in volatile memory;

collecting a third environmental reading at time T3 with the sensor package;

storing said third 3 environmental reading in volatile memory;

computing an average environmental reading from T1, T2, and T3 to produce an environmental reading average;

computing the difference between the computed environmental reading average and the default clean air reading;

defining a new alarm threshold by shifting the default alarm threshold by a value calculated from the difference between the computed environmental reading average and the default clean air reading;

storing said new alarm threshold as the default alarm threshold in the volatile memory;

generating an alarm if an environmental reading is greater than the default alarm threshold stored in said volatile memory.

11. The method of claim 10 wherein the time interval from T1 to T2 and from T2 to T3 is greater than 30 minutes.

12. The method of claim 10 further comprising the step of calculating the difference between the first and second environmental readings, and the difference between the second and third environmental readings, evaluating each calculated difference as a function of the time period between the environmental readings, and shifting the new alarm threshold by a value smaller than the difference between the computed environmental reading avg. and the default clean air reading to increase system sensitivity.

13. The method of claim 10 further comprising the step of calculating the difference between the first and second environmental readings, and the difference between the second and third environmental readings, evaluating each calculated difference as a function of the time period between the environmental readings, and shifting the new alarm threshold by a value greater than the difference between the computed environmental reading average and the default clean air reading to decrease system sensitivity.

14. The method of claim 10 further comprising the step of calculating the difference between the first and second environmental readings, and the difference between the second and third environmental readings, evaluating each calculated difference as a function of the time period between the environmental readings, and shifting the new alarm threshold by the difference between the computed environmental reading average and the default clean air reading to maintain system sensitivity.

15. The method of claim 10 further comprising the step of synchronizing microprocessor inactive periods with the inactive periods of said alarm means by coupling said microprocessor to said alarm means ASIC sensitivity set pin, wherein said microprocessor detects said ASIC's inactive period using said sensitivity set pin and synchronizes microprocessor active and inactive periods with the active and inactive periods of said ASIC's sensitivity set pin.

16. A microprocessor controlled hazardous condition detection system comprising:

a housing containing a sensor package, said sensor package containing an ionization type smoke sensor, said smoke sensor being exposed to the ambient environment and taking periodic readings of the ionization level in an ambient environment;

an alarm means coupled to said sensor package, disposed in said housing;

a microprocessor having volatile and non-volatile memory coupled to said sensor package and said alarm means said non-volatile memory having an alarm differential value and a clean air default value stored therein;

wherein a default alarm threshold is determined by adding said differential value to said clean air default value;

wherein said microprocessor receives periodic readings of the ionization levels in the ambient environment from said sensor package, stores said periodic readings in said volatile memory, calculates an average of a plurality of said periodic readings over a predetermined period of time, and generates a new alarm threshold by shifting the default air alarm threshold loaded into said volatile memory by a value generated from the difference in the calculated average environmental reading and said clean air default value;

wherein upon detection of an ambient environmental condition outside of said alarm threshold stored in said volatile memory said microprocessor causes said alarm means to generate an alarm condition.

17. The system of claim 16 wherein said alarm means is coupled to said microprocessor through an alarm mean ASIC sensitivity set pin, said microprocessor using said sensitivity set pin to synchronize active and inactive periods with the active and inactive periods of said ASIC.

* * * * *